US008153871B1

(12) United States Patent
Fagrelius et al.

(10) Patent No.: US 8,153,871 B1
(45) Date of Patent: Apr. 10, 2012

(54) DEVICE FOR MOUNTING A SENSOR ON A MUSICAL INSTRUMENT FOR AMPLIFICATION

(76) Inventors: Erik Kim Fagrelius, Chicago, IL (US); Don F Moyer, Chicago, IL (US)

( * ) Notice: Subject to any disclaimer, the term of this patent is extended or adjusted under 35 U.S.C. 154(b) by 0 days.

(21) Appl. No.: 12/930,620

(22) Filed: Jan. 12, 2011

(51) Int. Cl.
*G10D 13/02* (2006.01)

(52) U.S. Cl. ..... 84/267; 84/290

(58) Field of Classification Search ..... 84/267, 84/290, 291, 294, 311
See application file for complete search history.

(56) References Cited

U.S. PATENT DOCUMENTS

| | | | |
|---|---|---|---|
| 2,145,490 A | 1/1939 | Miller | |
| 3,715,446 A | 2/1973 | Kosinski | |
| 4,026,178 A | 5/1977 | Fuller | |
| 4,142,435 A | 3/1979 | Pozar | |
| 4,184,399 A | 1/1980 | Zuniga | |
| 4,854,210 A | 8/1989 | Palazzolo | |
| 2003/0019349 A1 * | 1/2003 | Green | 84/731 |

OTHER PUBLICATIONS

Jonas Lohse, Double bass guide; Gear guide; Pickups + Microphones (http://www.doublebassguide.com/?page_id=21, last visited on Dec. 16).

* cited by examiner

*Primary Examiner* — Kimberly Lockett
(74) *Attorney, Agent, or Firm* — Miri Yoon; Patent Clinic at JMLS

(57) ABSTRACT

A device for mounting a sensor on a musical instrument comprises at least a first sensor held by a first arm so that a user can place the first sensor at a desired first distance measured normal to the first string and can place the first sensor at a desired first position anywhere in a first range along the first string, the first range being at least seventy percent of a least distance between termination of a fingerboard and a bridge, where the user can change the first distance during normal playing and can also change the first position during normal playing, and where the first sensor stays at the first distance during normal playing unless changed by the user and the first sensor stays at the first position during normal playing unless changed by the user.

13 Claims, 1 Drawing Sheet

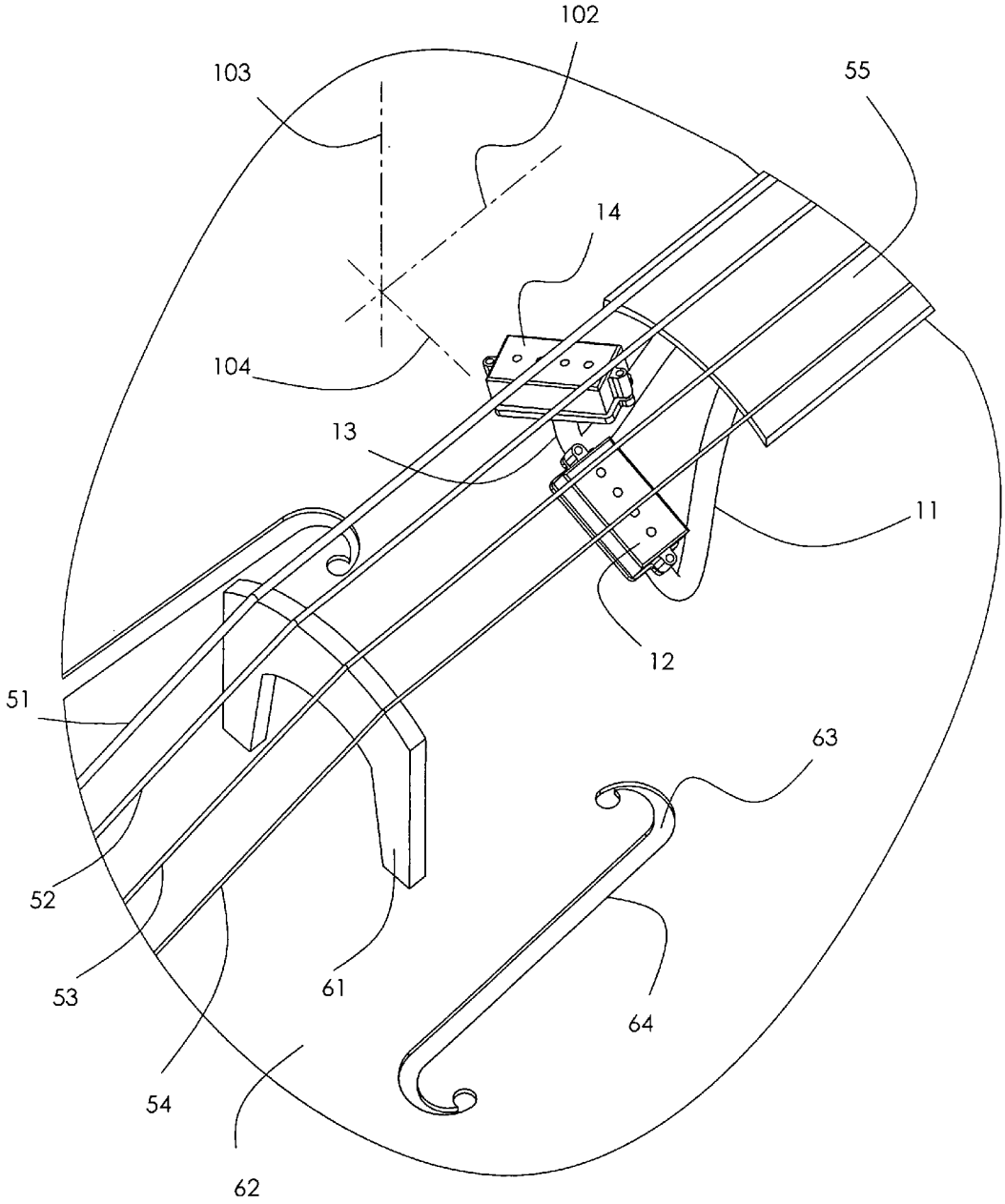
102
103
55
14
104
13
11
12
51
63
52
53
61
64
54
62

DEVICE FOR MOUNTING A SENSOR ON A MUSICAL INSTRUMENT FOR AMPLIFICATION

A device for mounting a sensor on a musical instrument for amplification allows an unexpectedly great range of adjustment of sound quality as determined by a user.

The FIGURE shows an apparatus for mounting a sensor 12 on a musical instrument 62 for amplification.

As shown in the FIGURE, the musical instrument 62 has a body defining a sound box 63, a F-hole 64, and a plurality of strings 51, 52, 53, 54 along a fingerboard 55 and across a bridge 61.

A device for mounting a sensor on a musical instrument for amplification comprises at least a first sensor and a first arm. As shown in the FIGURE, the device for mounting a sensor on a musical instrument for amplification comprises a first arm 11 and a first sensor 12. The first arm 11 has a fixed end and a free end. The fixed end of the first arm 11 is fixed relative to at least a first string of the musical instrument 62. The first sensor 12 is connected to the first arm 11 and the first arm 11 can allow the user to place the first sensor 12 at a desired first distance measured normal to the first string. The first arm 11 can further allow the user to place the first sensor 12 at a desired first position anywhere in a first range along the first string, and the first range is at least seventy percent of a least distance between termination of the fingerboard 55 and the bridge 61. The user can change the first distance during normal playing. The user can also change the first position during normal playing. The first sensor 12 stays at the first distance during normal playing unless the user changes the first distance. The first sensor 12 further stays at the first position during normal playing unless the user changes the first position.

Though the FIGURE shows the first arm 11 and a second arm 13 with a two component sensor 12 on the first arm 11 and a two component sensor 14 on the second arm 13, there can be only a one component sensor on the first arm 11. There can be four arms each with one sensor. There can be more than four arms—each arm holding a sensor with at least one component. There can be less than four arms—each holding a sensor with at least one component.

The arm can be made of a bendable material to allow the user to change a position during normal playing unless changed by the user. As shown in the FIGURE, the first arm 11 is bendable for placing the first sensor 12 at the desired first distance measured normal to the first string. The first arm 11 is also bendable for placing the first sensor 12 at a desired first position anywhere in a first range along the first string. The first bendable arm allows the user to change the first distance during normal playing. The first bendable arm further allows the user to change the first position during normal playing. The first arm is bendable so that the first sensor stays at the first distance during normal playing unless changed by the user. The first arm is bendable so that the first sensor stays at the first position during normal playing unless changed by the user. The arm can be made of a wire. The arm can also be made of a plurality of link elements, and each link element comprises of a ball at one end and a ball socket at the other end for receiving the ball of a directly neighboring link element.

As shown in the FIGURE, the first arm 11 can provide the first sensor 12 at least three degrees of freedom relative to the first string. The three degrees of freedom can include translation along each of three orthogonal axes 102, 103, 104. These three degrees of freedom can also include translation along each of two of the three orthogonal axes and rotation about one of these two orthogonal axes.

The arm can provide the sensor up to a total of six degrees of freedom relative to at least the first string of the musical instrument. A bendable arm provides six degrees of freedom to the sensor relative to the fixed end of the bendable arm. The six degree of freedom includes translations along each of the three orthogonal axes 102, 103, 104 and rotation about each of these three orthogonal axes. Other forms of the arm could provide less than six degrees of freedom to the sensor.

The sensors can have one component, can have two components as shown in the FIGURE, and can have more than two components. As shown in the FIGURE, the first sensor 12 can have two components—a first component can be positioned relative to the first string and a second component relative to a second string of the musical instrument 62. The FIGURE also shows a second two component sensor 14 positioned relative to a third and a fourth string of the musical instrument 62.

The sensor can be magnetic, electric or optical, detecting motions of at least first string of the musical instrument. When the first sensor is a magnetic pickup, the first sensor senses first string vibrations because the first string vibrations change the magnetic field sensed by the first sensor.

The device for mounting a sensor on a musical instrument for amplification can further comprise of a base, connected to the arm. For a large musical instrument such as bass, the base can be mounted under the fingerboard of the musical instrument. The base can contain electronics associated with amplifying signals from the first sensor.

This invention can be combined with other sensors such as microphones or pressure transducers.

The invention claimed is:

1. A device for mounting a sensor on a musical instrument for amplification, the device comprising:

a first arm having a fixed end and a free end, where fixed end is fixed relative to at least a first string of a musical instrument, the musical instrument having at least the first string, the first string being stretched along a fingerboard and across a bridge; and a first sensor connected to the first arm, where the first arm is for placing the first sensor at a desired first distance measured normal to the first string, where the first arm is for placing the first sensor at a desired first position anywhere in a first range along the first string, where the first range is at least seventy percent of a least distance between termination of the fingerboard and the bridge, where the first distance can be changed by a user during normal playing, where the first position can be changed by the user during normal playing, where the first sensor stays at the first distance during normal playing unless changed by the user, where the first sensor stays at the first position during normal playing unless changed by the user.

2. A device for mounting a sensor on a musical instrument for amplification, the device comprising:

a first arm having a fixed end and a free end, where fixed end is fixed relative to at least a first string of a musical instrument, the musical instrument having at least the first string, the first string being stretched along a fingerboard and across a bridge and the instrument having a second string; and a first sensor connected to the first arm, where the first sensor has two components, a first component and a second component, where the first arm is for placing the first component at a desired first distance measured normal to the first string, where the first arm is also for placing the second component at a desired second distance measured normal to the second string, where the first arm is for placing the first sensor at a desired first position anywhere in a first range along the first string, where the first range is at least seventy percent of a least distance between termination of the fingerboard and the bridge, where the first distance can be changed by a user during normal playing, where the second distance can be changed by the user during normal playing, where the first position can be changed by the user during normal playing, where the first component stays at the first distance during normal playing unless changed by the user, where the second component stays at the second distance during normal playing unless changed by the user, and where the first sensor stays at the first position during normal playing unless changed by the user.

3. A device for mounting a sensor on a musical instrument for amplification, the device comprising:

a first arm having a fixed end and a free end, where fixed end is fixed relative to at least a first string of a musical instrument, the musical instrument having at least the first string, the first string being stretched along a fingerboard and across a bridge; and a first sensor connected to the first arm, where the first arm is bendable for placing the first sensor at a desired first distance measured normal to the first string, where the first arm is bendable for placing the first sensor at a desired first position anywhere in a first range along the first string, where the first range is at least seventy percent of a least distance between termination of the fingerboard and the bridge, where the first arm is bendable so that the first distance can be changed by a user during normal playing, where the first arm is bendable so that the first position can be changed by the user during normal playing, where the first arm is bendable so that the first sensor stays at the first distance during normal playing unless changed by the user, where the first arm is bendable so that the first sensor stays at the first position during normal playing unless changed by the user.

4. The device for mounting a sensor on a musical instrument for amplification of claim 1, wherein the first arm allows the first sensor at least three degrees of freedom to be positioned relative to the first string of the musical instrument, where the three degrees of freedom include translation along each of three orthogonal axes.

5. The device for mounting a sensor on a musical instrument for amplification of claim 1, wherein the first arm allows the first sensor at least three degrees of freedom to be positioned relative to the first string of the musical instrument, where the three degrees of freedom include translation along each of two axes of three orthogonal axes and rotation about one axis of the two axes.

6. The device for mounting a sensor on a musical instrument for amplification of claim 1, wherein the first arm allows the first sensor four degrees of freedom to be positioned relative to the first string of the musical instrument, where the four degrees of freedom include translation along each of three orthogonal axes, and rotation about one axis of the three orthogonal axes.

7. The device for mounting a sensor on a musical instrument for amplification of claim 1, wherein the first arm allows the first sensor five degrees of freedom to be positioned relative to the first string of the musical instrument, where the five degrees of freedom include translation along each of three orthogonal axes, and rotation about each of two axes of the three orthogonal axes.

8. The device for mounting a sensor on a musical instrument for amplification of claim 1, wherein the first arm allows the first sensor six degrees of freedom to be positioned relative to the first string of the musical instrument, where the six degrees of freedom include translations along each of three orthogonal axes, and rotation about each of the three orthogonal axes.

9. The device for mounting a sensor on a musical instrument for amplification of claim 2, wherein the first arm allows the first sensor four degrees of freedom to be positioned relative to the first string of the musical instrument, where the four degrees of freedom include translation along each of three orthogonal axes of the musical instrument, and rotation about one of the three orthogonal axes.

10. The device for mounting a sensor on a musical instrument for amplification of claim 2, wherein the first arm allows the first sensor five degrees of freedom to be positioned relative to the first string of the musical instrument, where the five degrees of freedom include translation along each of three orthogonal axes, and rotation about each of two axes of the three orthogonal axes.

11. The device for mounting a sensor on a musical instrument for amplification of claim 2, wherein the first arm allows the first sensor six degrees of freedom to be positioned relative to the first string of the musical instrument, where the six degrees of freedom include translations along each of three orthogonal axes, and rotation about each of the three orthogonal axes.

12. The device for mounting a sensor on a musical instrument for amplification of claim 3, wherein the first arm is made of a plurality of link elements, and each link element comprises a ball at one end and a ball socket at the other end for receiving the ball of a directly neighboring link element.

13. The device for mounting a sensor on a musical instrument for amplification of claim 3, wherein the first arm is made of a wire.

* * * * *